United States Patent [19]

Padovani

[11] Patent Number: 4,867,313

[45] Date of Patent: Sep. 19, 1989

[54] CUP FOR COFFEE, OR SIMILAR DRINKS, FORMED OF SYNTHETIC THERMOPLASTICS MATERIAL

[75] Inventor: Pietro Padovani, Verona, Italy

[73] Assignee: I.S.A.P. SpA (Industrie Specializzate Articoli Plastici), Parona, Italy

[21] Appl. No.: 163,268

[22] Filed: Mar. 2, 1988

[30] Foreign Application Priority Data

Mar. 3, 1987 [IT] Italy ..... 84909 A/87
Dec. 28, 1987 [IT] Italy ..... 84990 A/87

[51] Int. Cl.[4] ..... B65D 21/02; B65D 85/72

[52] U.S. Cl. ..... 206/519; 206/515; 215/10; 229/1.5 B

[58] Field of Search ..... 215/1 R, 1 C, 10, 12.1; 229/1.5 B; 206/499, 515, 519

[56] References Cited

U.S. PATENT DOCUMENTS

| | | | |
|---|---|---|---|
| 2,988,258 | 6/1961 | Witzke | 206/519 X |
| 3,347,411 | 10/1967 | Kalata et al. | 229/1.5 B X |
| 3,358,879 | 12/1967 | Mueller | 206/519 |
| 3,612,346 | 10/1971 | Schneider | 206/519 |
| 3,804,281 | 4/1974 | Eckdahl | 206/519 X |
| 4,519,219 | 5/1985 | Prepodnik et al. | 206/519 X |
| 4,610,351 | 9/1986 | Coles et al. | 206/519 X |

FOREIGN PATENT DOCUMENTS

| | | | |
|---|---|---|---|
| 2413286 | 8/1979 | France | 206/519 |
| 1379371 | 1/1973 | United Kingdom | 229/1.5 B |
| 1325230 | 8/1973 | United Kingdom | 206/515 |
| 2061699 | 5/1981 | United Kingdom | 206/519 |

*Primary Examiner*—Sue A. Weaver
*Attorney, Agent, or Firm*—Ladas & Parry

[57] ABSTRACT

A cup for coffee, or similar drinks, formed of synthetic thermoplastics material comprises a portion (3, 3', 3'') provided with a base (5, 5') and a shoulder (7) having a collar (8, 8') ending in a flare (14) at the top (9) of the cup, a portion (4, 4', 4'') running from this top which is provided with a shoulder (11) which is, in turn, connected to a lower edge (13) by means of a section of wall (12, 12'), in which the shoulder (7) rests at least partly on the flare (14) in a plane other than that which includes the top (9) of an identical cup placed beneath it.

20 Claims, 4 Drawing Sheets

FIG. 1
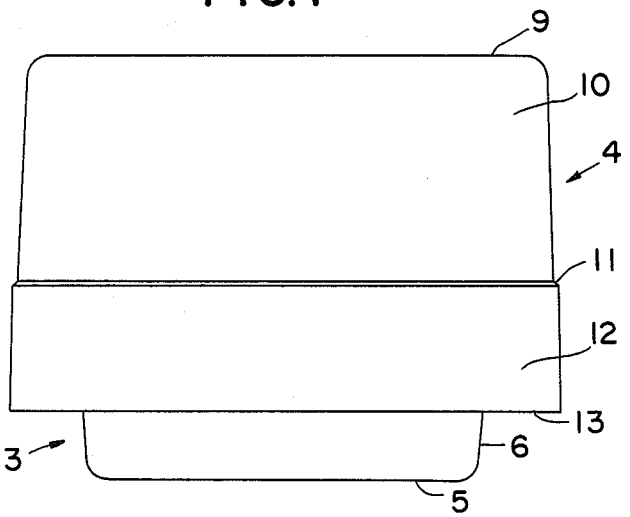
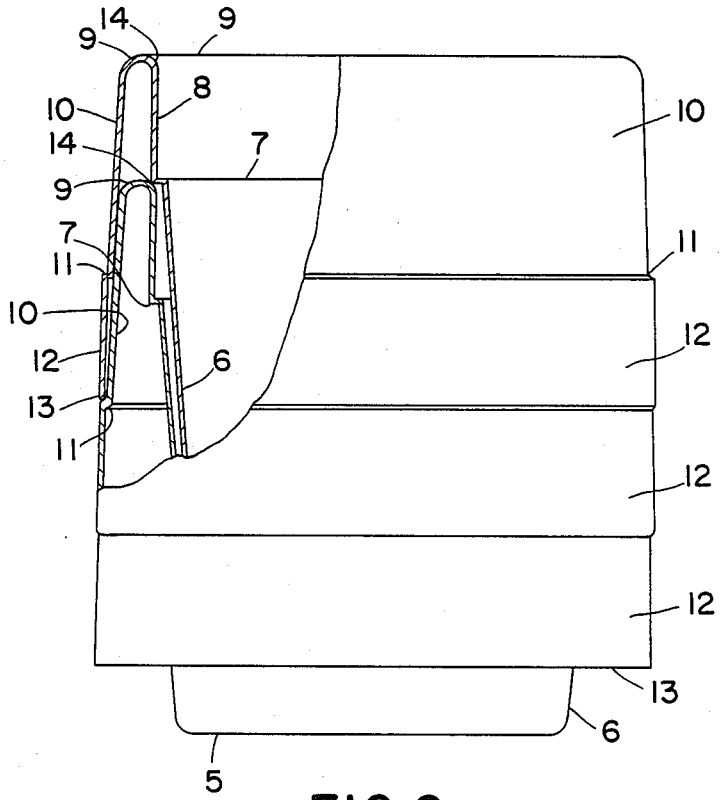
FIG. 2a

FIG. 1a
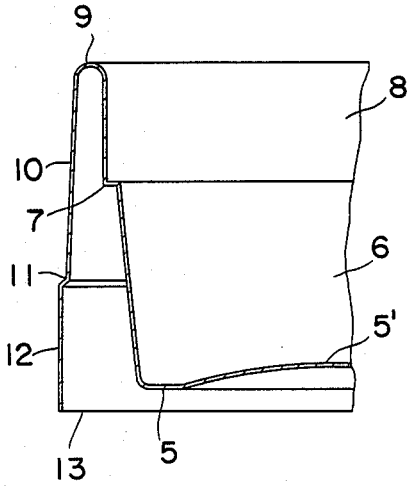
FIG. 1b
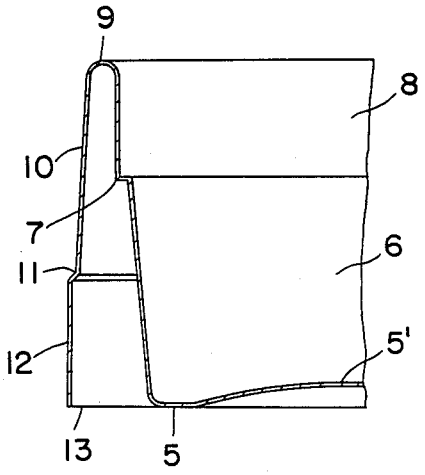
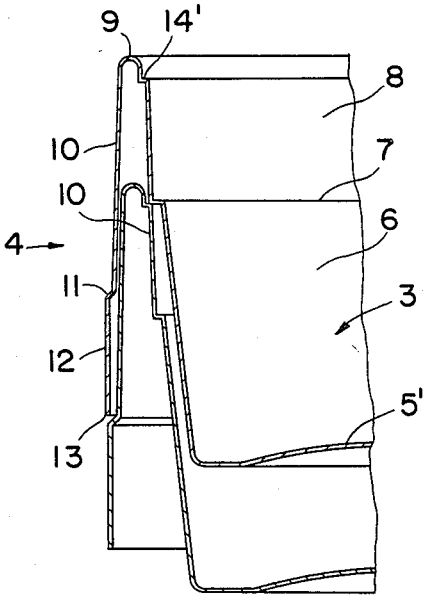
FIG. 2b

CUP FOR COFFEE, OR SIMILAR DRINKS, FORMED OF SYNTHETIC THERMOPLASTICS MATERIAL

BACKGROUND OF THE INVENTION

The present invention relates to a cup for coffee, or similar drinks formed of synthetic thermoplastics material and comprising an inner frusto-conical hollow portion which diverges upwardly to the circular top of the cup and provided with a base having a spherical cap surface which is arched inwardly, an outer hollow frusto-conical portion which diverges downwardly from the top of the cup, this outer portion being provided with an outward shoulder attached peripherally at its lower edge to a section of wall, in which said shoulder, said section of wall and said edge constitute the unit stacking height of the outer portion and in which the inner portion has a greater height than the outer portion.

Cups of this type have the disadvantage that they cannot be stably stacked. The slight play between one cup and another in a stack, which is necessary so that the cups do not become stuck one within another, makes it easy for the upper cups in a stack to be displaced out of line, for example, when the top cup is taken from the stack for use, or for example, when a stack is moved from one place to another. Such displacement causes the stack to lean over and can cause it to fall.

Another disadvantage is that due to the low stability of each individual cup, caused by the fact that the lower edge of the outer portion is at a distance from the plane supporting the cup, the cup can be tipped over and the contents spilled.

Another disadvantage lies in the fact that a stack of cups of this type has a lateral surface consisting of a series of frusto-conical surfaces, and this gives rise to difficulties when printing frusto-conical surfaces due to discontinuities in the available surface.

An object of the invention is to at least minimize such disadvantages.

BRIEF DESCRIPTION OF THE INVENTION

According to the present invention, there is provided a cup for coffee or similar drinks formed of synthetic thermoplastics material and comprising an inner portion which diverges upwardly to the circular top of the cup, an outer hollow frusto-conical portion which diverges downwardly from the top of the cup to a lower edge, this outer portion having an outward shoulder defining a lower section of wall adjacent the aforementioned edge, the shoulder, the section of wall and the edge defining the unit stacking height of the outer portion and in which the inner portion is provided with a shoulder in the form of a circular rim from the periphery of which extends a collar ending in a flare which joins the collar to the top of the cup, the collar and the flare also defining the unit stacking height wherein the rim rests at least partly on the flare in a plane other than that which includes the top of an identical cup placed beneath it.

The main advantage deriving from this invention is the fact that the cup can form stacks which have particular stability.

Another advantage is due to the fact that the lower edge of the outer portion of the cup forming the base supporting the cup is at a distance from the supporting plane whereby the cup cannot be tipped with respect to the vertical axis and its contents spilled.

Another advantage is confirmed by the fact that the cup, in certain embodiments, is able to form stacks with an outer cylindrical surface which can easily be printed.

IN THE DRAWINGS

The present invention will be further illustrated by way of example with reference to the accompanying drawings in which:

FIG. 1 is a side view of a cup in accordance with the invention;

FIGS. 1*a* and 1*b* are partial sectional views depicting certain variations to the cup of FIG. 1;

FIGS. 2*a* and 2*b* are side views of three stacked cups, certain parts of which are illustrated in cross section in FIG. 2*a* and FIG. 2*b;*

FIG. 3 is a side view of a second embodiment of a cup in accordance with the invention, shown partly in cross-section;

FIGS. 3*a* and 3*b* are partial sectional views depicting certain variations to the cup of FIG. 1;

FIG. 4 is a side view of a third embodiment of a cup in accordance with the invention, partly in cross section; and FIG. 4*a* is a partial sectional view depicting a certain variation to the cup of FIG. 4.

DETAILED DESCRIPTION OF THE INVENTION

Figure 3:
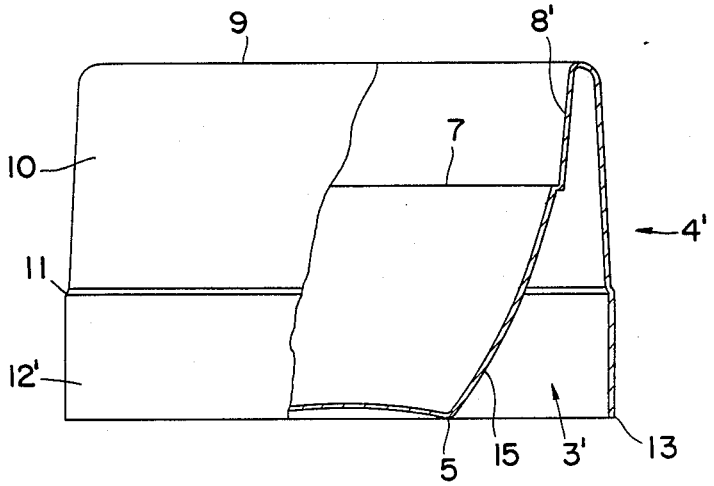

Bearing in mind that the same reference numbers correspond to identical or equivalent parts in the Figures, it will be seen in FIG. 1 that the cup includes an inner portion 3 which determines the capacity of the cup and an outer portion 4 which partly covers the inner portion.

Portion 3 has a circular base 5, rounded as a spherical cap 5' towards the interior, as shown in FIGS. 1*a*, 1*b* and 2*b* though not apparent in FIGS. 1 and 2*a*, and a frusto-conical wall 6 which diverges upwardly rising from base 5 and, as seen in FIG. 2*a*, is provided with a shoulder 7 in the form of a circular rim from the periphery of which extends a cylindrical collar 8 with a flare or bent or curved portion 14 at the circular top 9 of the cup.

Portion 4 is rounded from the top 9 downward to a frusto-conical wall 10 which diverges towards the base and is connected by means of a shoulder 11 to a section of wall 12, which is again depicted as being frusto-conical, terminating at an edge 13. For reasons Which will be subsequently discussed, wall 12 may be cylindrical in alternative embodiments.

The cup of FIG. 1 rests upon base 5. In order to improve this cup's stability, the alternate embodiments of FIGS. 1*a* and 1*b* depict a cup whose base 5 is above (FIG. 1*a*) or at (FIG. 1*b*) edge 13 so that the wider diameter edge 13 provides a base for the cup. Of course, there may be a tradeoff of having less volume in the cup (depending upon the dimensions selected) of FIGS. 1*a* or 1*b* compared to the cup of FIG. 1.

With particular reference to FIGS. 2*a* and 2*b*, a stack of the cups of FIG. 1 are depicted. It will be seen that the shoulders 7 and 11 and the taper of the portions 3 and 4 have been selected so that the frusto-conical walls 6 and 10 of those portions lie at a short distance from one another.

It will also be seen from FIG. 2*a* that when edge 13 of a stacked cup rests on shoulder 11 of the cup beneath it, the peripheral portion of the shoulder 7 of the stacked cup rests on the flare 14 of the underlying cup in a plane located below the plane which includes the circular top 9 of the underlying cup.

The double support between portions 3 and portions 4 make it particularly difficult to displace or tilt a cup with respect to the underlying cup thus conferring good stability to a stack of cups.

The curve of flare 14 towards the interior of the cup acts as a guide to correct stacking in that it encourages the cup which is placed upon it to become centered and at the same time resists lateral displacement of the stacked cups.

According to an alternate embodiment which is illustrated by FIG. 2*b*, flare 14 of the cup mouth may include an annular recess 14' in which the shoulder 7 of a cup placed upon it will be at least partly received to even more effectively resist displacement of the upper cup with respect to the axis of the stack.

The spacing between the portions 3 of the cups in a stack may correspond to the spacing between the portions 4.

The plane of support between two portions 3 is located below the plane passing through the circular top 9 of the cup.

Figure 4:
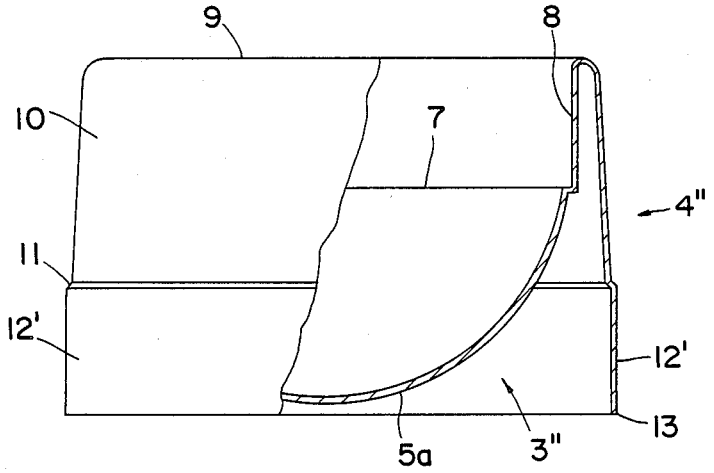

In order to eliminate the difficulties of printing frusto-conical surfaces, portions 4 may be provided with cylindrical sections of wall instead of frusto-conical sections, as can be seen at numeral 12' in FIGS. 3 and 4.

In FIG. 3 it will be noted that the height of portion 3' is equal to the height of portion 4' with the result that the cup rests in a particular stable manner upon a horizontal plane.

In fact, edge 13 has a greater diameter than does circular top 9. In this situation the size of the diameter or base 5, which is considerably reduced (as will be seen in comparison with FIG. 1), has no influence on the stability of the cup. The base 5 of the cup is preferably arched inwardly, as can be seen in FIG. 3, to define spherical cap 5'. .

In this type of cup, portion 3' has its lower portion 15 tapering conically so that a smaller quantity of drink accumulates in the lower part of the cup.

Figure 3A:
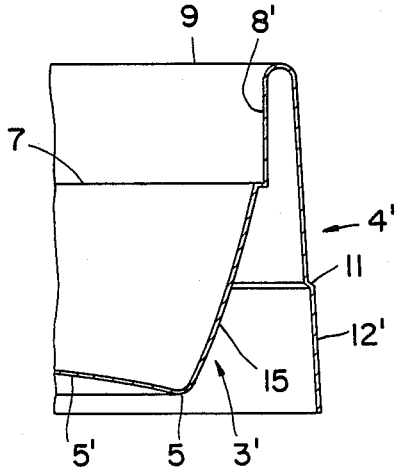
Figure 3B:
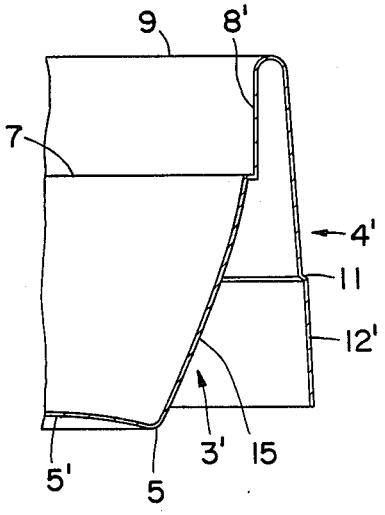

The cup of FIG. 3 can be modified, if desired, to have either a base which is higher than edge 13 (FIG. 3*a*) or projects below edge 13 (FIG. 3*b*).

As will be seen in FIG. 4, portion 3'' of the cup illustrated is of lesser height than portion 4'' with the result that base of portions 3'' is raised above the plane on which edge 13 rests.

This arrangement is particularly advantageous when the plane supporting the cup is of a thermoplastics material which can easily be damaged by heat.

Portion 3'' of the cup is in the form of an outwardly arched spherical cap, this aiding mixing of the contents of the cup by means of a spoon. This enables the sugar which is normally added to coffee, for example, to be dissolved easily and quickly.

Figure 4A:
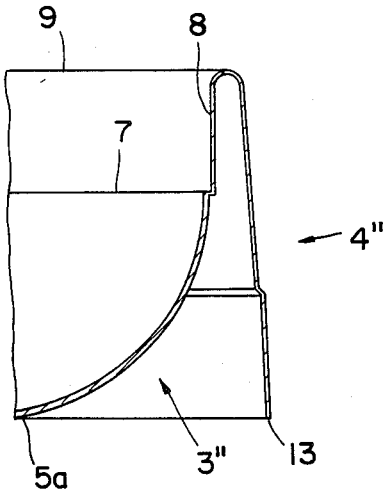

The cup of FIG. 4 can be modified, if desired, so that the very bottom 5*a* of portion 3'' approaches or coincides with the plane defined by edge 13, as shown in FIG. 4*a*. Of course, this embodiment does not enjoy the heat isolation of the embodiment of FIG. 4, but that disadvantage may be offset by its greater capacity to hold a liquid or drink.

The cup which is the object of the invention can be formed by means of an injection process, but it can also be formed from a sheet using a thermoforming process.

It is advantageous that the cup which is designed to be used as a disposable container i.e., intended to be used only once and then thrown away, should have thin walls, a very small mass and consequently a very low cost.

I claim:

1. A cup of coffee or similar drinks comprising a circular top; an inner portion which diverges upwardly to the circular top of the cup, an outer generally hollow frusto-conical portion which diverges downwardly from the top of the cup to a lower edge, said outer portion having an outward shoulder defining a lower section of wall adjacent said edge, said outward shoulder, said section of wall and said edge defining the unit stacking height of said cup when stacked with identical cups; the inner portion having a shoulder in the form of a circular rim from the periphery of which extends a collar ending in a flare which joins the collar to the top of the cup, said flare being located below the top of the cup, said rim, said collar and said flare also defining said unit stacking height wherein said rim rests at least partly on the flare in a plane other than that which includes the top of an identical cup placed beneath it.

2. A cup as claimed in claim 1, in which the inner portion is of a height corresponding to the height of the outer portion.

3. A cup as claimed in claim 1, in which the inner portion is of a height less than the height of the outer portion.

4. A cup as claimed in claim 1, in which the collar is cylindrical.

5. A cup as claimed in claim 1, in which the collar is frusto-conical and diverges upwardly.

6. A cup as claimed in claim 1, in which the section of wall is cylindrical.

7. A cup as claimed in claim 1, in which the section of wall is frusto-conical and diverges downwardly.

8. A cup as claimed in claim 1, in which the rim rests at least partly in a circular recess in the flare of a cup lying below it.

9. A cup as claimed in claim 1, in which a lower part of the inner portion is tapered conically so as to reduce considerably the diameter of the base.

10. A cup as claimed in claim 3 in which the inner portion is provided with a spherical domed base arching towards the exterior of the cup.

11. A cup as claimed in claim 1, wherein said inner portion is of a height greater than the height of the outer portion.

12. A hand-held cup comprising:

(a) a circular top;

(b) an inner food or drink receiving portion having a circular rim and a collar, said collar extending upwardly from said rim and mating with said circular top at a flare, said flare being located below said circular top; and (c) an outer hollow portion which diverges downwardly from the top, said outer portion having a generally frusto-conical portion, a lower section of wall adjacent a lower edge of said outer portion, and a shoulder coupling said lower section of wall and said generally frusto-conical portion; wherein the height of said lower section of wall defines the unit stacking height of said cup when stacked with identical cups and wherein, when stacked, a rim of one cup rests at least partially upon the flare of an adjacent cup in a plane other than the plane defined by the top of said adjacent cup.

13. A cup as claimed in claim 12, in which the inner portion is of a height corresponding to the height of the outer portion.

14. A cup as claimed in claim 12, in which the inner portion is of a height less than the height of the outer portion.

15. A cup as claimed in claim 12, wherein said inner portion is of a height greater than the height of the outer portion.

16. A cup as claimed in claim 12, in which the collar is cylindrical.

17. A cup as claimed in claim 12, in which the collar is frusto-conical and diverges upwardly.

18. A cup as defined in claim 12, in which the section of wall is cylindrical.

19. A cup as defined in claim 12, in which the section of wall is frusto-conical and diverges downwardly.

20. A stackable hand-held cup of the type which may be made by thermoforming a sheet of material, said cup comprising:

(a) an inner food or drink receiving portion including:

(i) an uppermost portion which defines a top of the cup;

(ii) first and second circular rims having a collar disposed between said rims, said rims being located below said uppermost portion, said first rim being closer to said uppermost portion than is said second rim, said collar having a height equal to the unit stacking height of the cup when stacked with identical cups; and (iii) a lower portion having a closed bottom which diverges upwardly toward said second rim;

(b) an outer portion generally spaced from said inner portion, said outer portion having:

(i) an uppermost portion which joins the uppermost portion of the food or drink receiving portion in a smooth, convex curve;

(ii) an outer generally hollow frusto-conical portion which diverges downwardly from said top to a third rim; and (iii) an outward shoulder which extends downwardly from said third rim to a lower edge, the height of said shoulder being equal to the unit stacking height of the cup; and (c) wherein, when identical cups are stacked, the second rim rests upon the first rim of an identical cup placed beneath it and the lower edge rests upon the third rim of said identical cup placed beneath it.

* * * * *